US005165112A

United States Patent [19]

Dawes

[11] Patent Number: 5,165,112

[45] Date of Patent: Nov. 24, 1992

[54] NECKTIE

[76] Inventor: Charles R. Dawes, 4885 Gray St., Denver, Colo. 80212

[21] Appl. No.: 796,454

[22] Filed: Nov. 20, 1991

[51] Int. Cl.[5] ..... A41D 25/02

[52] U.S. Cl. ..... 2/150; 2/155; 2/157; 2/156; 2/149; 2/144

[58] Field of Search ..... 2/150, 149, 144, 145, 2/148, 155, 151, 156

[56] References Cited

U.S. PATENT DOCUMENTS

| | | | |
|---|---|---|---|
| 375,967 | 1/1888 | Wald | 2/150 |
| 1,897,734 | 2/1933 | Rossner | 2/145 |
| 2,388,993 | 11/1945 | Pfau | 2/150 |
| 2,588,576 | 3/1952 | Roop et al. | 2/145 |
| 2,662,226 | 12/1953 | Mayer | 2/155 |
| 2,738,513 | 3/1956 | Carty | 2/145 |
| 2,746,055 | 5/1956 | Gleason | 2/145 |
| 2,749,553 | 6/1956 | Miller | 2/145 |
| 2,813,273 | 11/1957 | Schreter | 2/145 |
| 2,860,346 | 11/1958 | Siebler et al. . | |
| 3,112,492 | 12/1963 | Less . | |
| 3,263,237 | 8/1966 | Bellon . | |
| 3,284,807 | 11/1966 | Espino . | |
| 3,360,800 | 1/1968 | Less . | |
| 3,526,004 | 9/1970 | Brandenburger . | |
| 3,562,815 | 2/1971 | Graham . | |
| 3,737,917 | 6/1973 | Orr | 2/150 |
| 3,761,964 | 11/1973 | Piper . | |
| 3,872,513 | 3/1975 | Beaudin | 2/155 |
| 3,872,513 | 3/1975 | Beaudin, Jr. et al. . | |
| 3,898,698 | 8/1975 | Byrd et al. . | |
| 4,513,453 | 4/1985 | Chen . | |
| 4,777,665 | 11/1988 | Akamatsu . | |

FOREIGN PATENT DOCUMENTS

| | | | |
|---|---|---|---|
| 629440 | 11/1927 | France | 2/150 |

*Primary Examiner*—Werner H. Schroeder
*Assistant Examiner*—Gloria Hale

[57] ABSTRACT

An assemblable necktie, having: a collar assembly, a knot assembly, a replacement tie assembly, and a tie assembly securement. The knot assembly comprises a first end portion having a collar loop formed therein for retaining the collar assembly, an intermediate portion, and, a second end portion. The first end portion, intermediate portion and the second end portion are so foldable so as to form a knot during use having the appearance of a knot in a conventional tie. The replaceable tie assembly is securable to the knot assembly. The tie assembly securement secures the tie assembly to the knot asssembly during use thereof, the tie assembly securement being concealed when the tie is formed.

13 Claims, 4 Drawing Sheets

NECKTIE

BACKGROUND OF THE INVENTION

1. Field of the Invention

This invention relates to neckties and more particularly to an assemblable necktie which is adapted to be easily and quickly fitted for the particular wearer.

2. Description of the Related Art

The most conventional and popular types of neckwear for children and adults of both sexes are the necktie and scarf. The present fashion industry allows for practically unlimited variations in the shapes, styles, lengths, widths, patterns, colors and materials used in the manufacturing of clothing. However, with respect to scarves and neckties, this industry has been somewhat limited due to the difficulties and problems in tying knots so that the knot is well formed and the end sections of the tie are the correct lengths and are in proper proportion to the user's body, neck and clothes.

Most attempts in the prior art for solving the problem of correctly tying a knot has involved simply using pre-formed or pretied neckties. Of these pre-formed necktie varieties, the most common involves the use of a "winged" support structure. For example, U.S. Pat. No. 3,562,815 issued to P. R. Graham, entitled "PRE-TIED NECKTIE", discloses a necktie having a cloth or fabric part which does not extend around the neck but is attached, in knotted form, to the medial part of a frame member of thin flat material. The frame member has two oppositely extending wings arranged to be inserted within the neck band and collar of the shirt. U.S. Pat. No. 3,112,492, issued to J. W. Less, entitled "PRE-TIED NECKTIES", discloses another "wing" type of support structure which imparts to the tie the appearance of having been hand tied.

Other pre-tied neckties involve the use of zippers. For example, U.S. Pat. No. 4,513,453, issued to J. Chen, et al., entitled "PRE-TIED NECKTIE", discloses a necktie having an inner tie with one end formed as a flexible opening and zipper fastener disposed therein, an outer tie containing a wide end of a conventional necktie, and a knot support with a hole near the lower end of the front wall. The upper end of the outer tie and the slider plate of the zipper fastener are affixed in the hole of the knot support.

U.S. Pat No. 3,898,698, issued to D. J. Byrd, et al., entitled "NECKTIE", discloses another pre-formed necktie assembly which utilizes a somewhat complicated zipper assembly.

U.S. Pat. No. 3,284,807, issued to C. Espino, entitled "NECKTIE HAVING A PREFORMED KNOT", discloses the use of a clutch carried by a clip and a pin carried by the tie which cooperate to assemble the finished assembly.

U.S. Pat. No. 3,263,237, issued to R. E. Bellon, entitled "PRE-KNOTTED NECKTIE", discloses a tie in which a slip knot is formed at the desired position of the knot in an exposed portion of the tie. The knot is formed by a tubular insert thereby providing a tubular opening in the slip knot which can receive the thinner hidden end of the tie. The tie is worn by the user by sliding the hidden end of the tie under the collar, inserting it through the tubular opening in the slip knot and pulling it tighter about the neck of the wearer.

U.S. Pat. No. 3,761,964, issued to J. M. Piper, entitled "NECKTIE AND TIE KNOT FORM THEREFOR", discloses a necktie having a simulated knot including a contoured form for providing the knot wherein the simulated knot is formed directly in the necktie itself in cooperation with the contoured form, the necktie being fastened by the form along the contours of the outer surface thereof so as directly form the assimilated knot from the necktie.

U.S. Pat. No. 3,526,004, issued to F. Brandenburger, entitled "NECKTIE AND REMOVABLE KNOT", discloses a combination utilizing a removable knot that permits a conventional necktie to be placed around the collar, the portable knot being slipped over the ends and adjusted against the collar, thereby eliminating the tying and untying operation. This combination permits use of a basically conventional tie and a novel knot.

Several attempts have been made to permit quick release of the collar portions of neckties. For example, U.S. Pat. No. 4,777,665, issued to S. Akamatsu, entitled "QUICK-RELEASE NECKTIE", discloses the use of neck bands extending from both sides of the knot and a pair of quick-releasable male and female fastenings attached to the ends of the neck bands. The male fastening is formed of a tongue-like plugged portion having wedge form, captively engaging projections on both faces. Similarly, U.S. Pat. No. 3,872,513, issued to G. P. Beaudin, Jr., et al., entitled "PULL AWAY SAFETY NECKWEAR", discloses a connecting member on a neck band being comprised of a male section and a female section joined together in a releasably engagable manner whereby the sections are completely separable from a pull upon portion of the neck band.

There have also been attempts to improve upon the ability of the wearer to have some control over the ultimate length of the necktie that he is using. For example, U.S. Pat. No. 2,860,346, issued to R. A. Siebler et. al., entitled "VARIABLE LENGTH AND STYLE NECKTIE" discloses a variable length tie in which fasteners are used to change the fold line at the bottom of the tie.

Tie clasps, tie tacks and tie anchors of many kinds have been proposed by prior art workers for holding the dependant portion of the tie adjacent the wearer's shirt front. However, such prior art devices have been so constructed that the tie is either so securely attached to the shirt front that there is no significant freedom of relative vertical movement between the tie and the shirt front of the necktie or the tie is too loosely retained. There has been a continuing need for improvement in such devices, both to attain the desired freedom of relative vertical movement while providing adequate constraint of the tie, and to devise a product of this tie which can be produced at less expense than has heretofore been involved. An attempt to improve on tie anchors is disclosed in U.S. Pat. No. 3,360,800, issued to J. W. Less, entitled "ARTICLES OF NECKWEAR", which discloses a tie anchor with specially designed arms for attaching to the shirt of a wearer.

Presently, therefore, there is no efficient way to reform or open the knot of a necktie or re-adjust the end sections of the tie to adjust them to the desired length without retying the necktie over again. Nor is there a way to efficiently interchange the knot or tie section for color coordination. Furthermore, there are no efficient quick and easy on and off means or methods for adjusting the collar length of a tie that can be adjusted for different neck sizes and which will also quickly and safely attach and detach and break away from itself if a strong pull is given to the necktie. Additionally, there exists no readily efficient method for holding a tie adjacent to the wearer's shirt or blouse.

As will be disclosed below, the present new invention offers easy and convenient solutions to the above problems by the following designs, features and methods.

SUMMARY OF THE INVENTION

The present invention comprises, in its broadest aspects, an assemblable necktie, having: a collar assembly, a knot assembly, a replaceable tie assembly, and tie assembly securing means. The knot assembly comprises a first end portion having a collar loop formed therein for retaining the collar assembly, an intermediate portion, and, a second end portion. The first end portion, intermediate portion and the second end portion are so foldable so as to form a knot during use having the appearance of a knot in a conventional tie. The replaceable tie assembly is securable to the knot assembly. The tie assembly securing means secures the tie assembly to the knot assembly during use thereof, the tie assembly securing means being concealed when the tie is formed.

With this design, the collar assembly, knot assembly, and tie assembly, are completely separate from each other and each section may be made from its own distinct color, pattern and/or material. The fold lines for the knot are pre-formed so that a well-constructed knot is made at all times that the necktie is constructed.

In another broad aspect of the present invention, a tie anchor is disclosed for retaining a necktie adjacent a wearer's shirt front, the necktie of the type having a front section generally exposed to view and a back section usually concealed from view. The tie anchor comprises an elongated back section strip of synthetic material, of the type that adheres when pressed together with a complimentary mating piece of fabric, the elongated strip being attached to a rear surface of the back section. A tie anchor attachment loop is provided which is formed of such a complimentary mating piece of fabric. A closed loop of elastic material is threaded through the attachment loop. A clasp is provided for separating the closed loop elastic material into a first subloop for attachment to the attachment loop and a second subloop. The second subloop is sized to efficiently engage the buttons of the wearer's shirt. The tie anchor adequately restrains the necktie yet allows such substantial freedom of relative vertical movement between the necktie and the shirt front as will adequately accommodate the wearer's body movements without undo tensioning of the necktie.

In yet another broad aspect of the present invention, a variable length necktie is disclosed comprising a relatively wide, elongated, tapered portion defining a front section of the necktie assembly that is generally exposed to view. The wide portion has a strip of synthetic fabric of the type that adheres when pressed together with a complimentary mating piece of fabric. The elongated strip is attached to the end of the narrower part of the wide portion.

A narrow portion is included defining a back section of the neck tie assembly that is usually concealed from view. The narrow portion has a strip of synthetic fabric of the type that adheres when pressed together with the complimentary mating piece of fabric. The strip is attached to an end of the narrow portion.

At least one tie link is included that comprises an elongated strip of tie material having a first end and a second end, the first end having a strip of synthetic fabric of the type that adheres when pressed together with complimentary mating piece of fabric. The strip is attached to a first face of the tie link, the second end having a similar strip of synthetic strip of material attached to a second face opposite the first face. The first and second ends of the tie link are thereby adapted to mate with either another tie link, the end of the narrow portion, or the end of the narrower part of the wide portion. Thus, the necktie can be made longer or shorter to accommodate the user's desires and requirements.

As used herein, the term "necktie" is defined broadly to include, for example, scarfs. Similarly, the term "shirt" is defined broadly to include, for example, a blouse.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figures 1, 7, 8, 12:
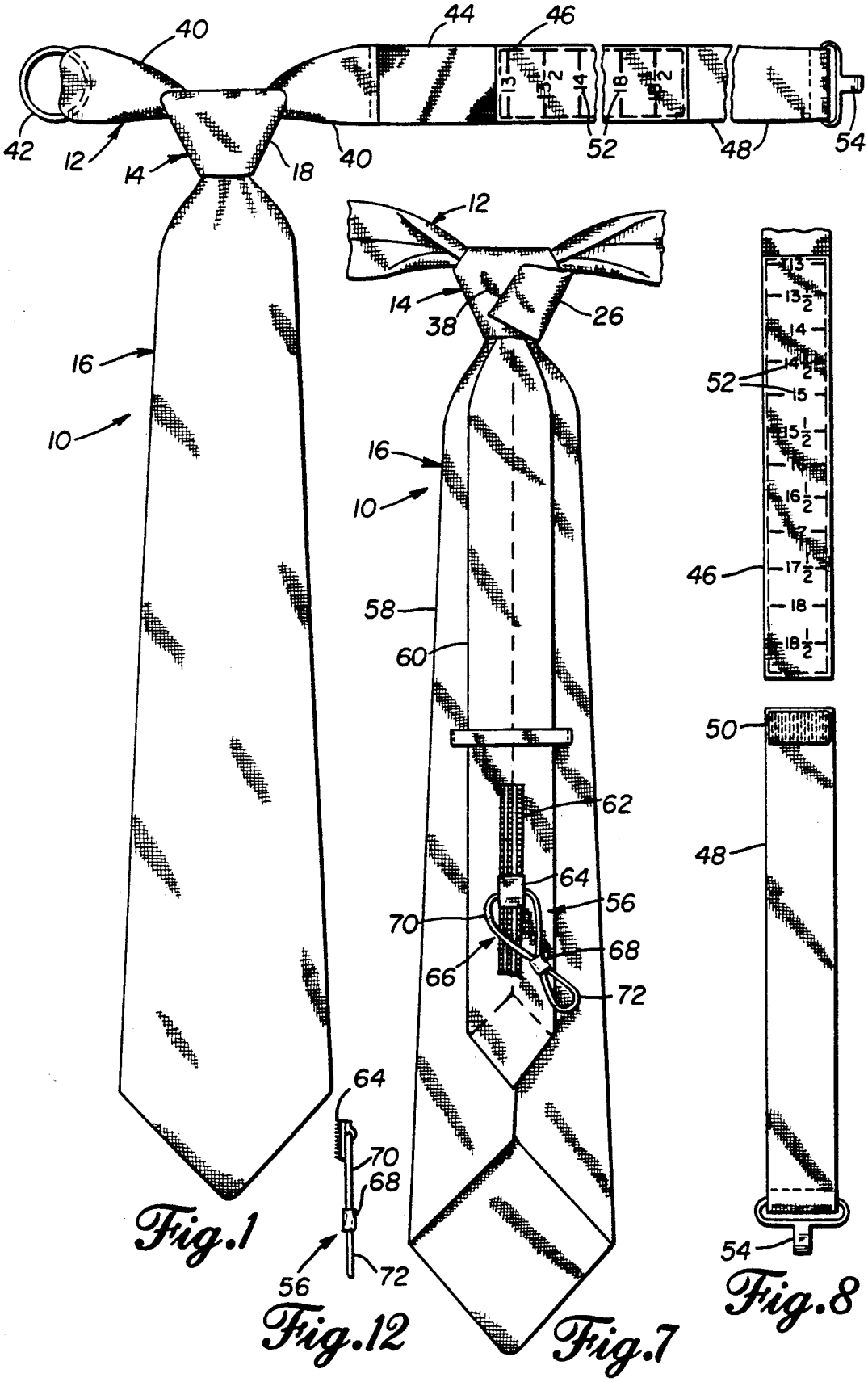
FIG. 1 is a front perspective view of a preferred embodiment of the present invention.
FIG. 7 is a rear perspective view of the assembled necktie of the present invention utilizing a tie anchor.
FIG. 8 illustrates the right side portion of the collar assembly shown in FIG. 1, with the Velcro TM shown detached.
FIG. 12 is a side view of the tie anchor illustrated in FIG. 7.

Referring to the drawings and the characters of reference marked thereon, FIG. 1 illustrates a preferred embodiment of the present invention shown in its fully assembled state, designated generally as 10. As illustrated in this figure, the assemblable necktie 10 comprises a collar assembly 12, a knot assembly 14 and a replaceable tie assembly 16. The manner in which the knot assembly is folded to form the appearance of a conventional knot is illustrated in FIGS. 2–6.

Figure 2:
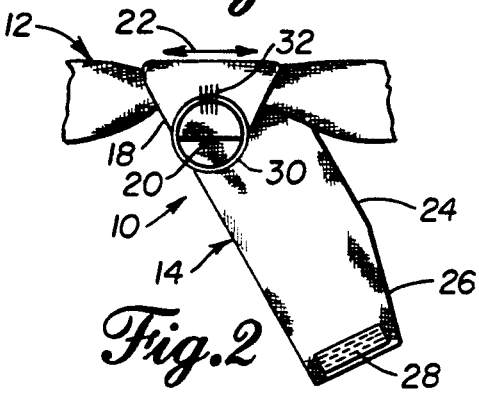
FIG. 2 is a front perspective view of the knot assembly with the collar assembly inserted therein, prior to the formation of the knot.

Referring now to FIG. 2, the knot assembly 14 comprises a first end portion 18 which is folded over and attached back onto itself (see numeral designation 20) to form a collar loop. Thus, the collar assembly 12 can slide back and forth through the loop 18, as indicated by arrows 22. The knot assembly 14 further includes an intermediate portion 24, which is used to form the front face of the knot and a second end portion 26.

The second end portion 26 includes a piece of synthetic fabric 28 attached thereto, of the type that adheres when pressed together with a complimentary mating piece of fabric, commonly sold under the trademark "Velcro".

Tie assembly securing means (i.e., tie ring) 30 is securely attached to the collar loop 18, for example by stitches 32.

Figure 3:
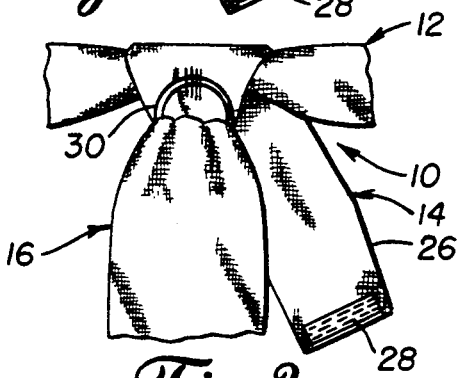
FIG. 3 illustrates the introduction of the replaceable tie assembly to the knot assembly.
Figure 6:
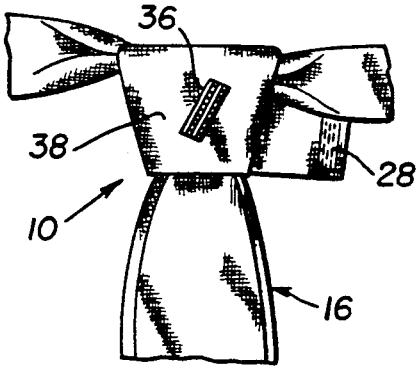
FIG. 6 is a rear view at the same stage of knot formation as FIG. 5.
Figure 4:
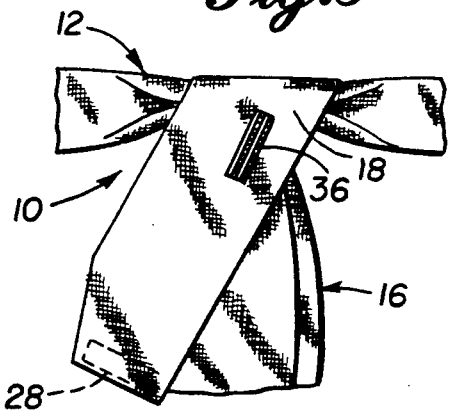
FIG. 4 is a rear perspective view of the necktie prior to knot formation.

Referring now to FIG. 3, the replaceable tie assembly 16 is shown having been threaded through the tie ring 30. FIG. 4 illustrates the necktie in the same sequence of construction as illustrated in FIG. 3, but from the rear view. As can be seen in this figure, the rear face of the first end portion 18 includes a complimentary mating piece of Velcro TM 36. As will be illustrated hereinafter, Velcro TM piece 36, will mate with Velcro TM piece 28 when the knot is constructed.

Figure 5:
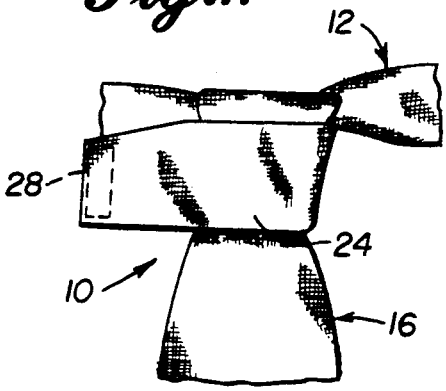
FIG. 5 is a front perspective view of the necktie during the first stage of knot formation.

Referring now to FIG. 5, the necktie 10 is turned around once again to illustrate the front view. In this figure, the intermediate portion 24 has been passed horizontally over the tie assembly securing means (now hidden from view) to form a front face of a tie knot. In FIG. 6, the necktie 10 is again illustrated in the rear view to show a mounting portion 38 forming a rear face of the tie knot.

Referring now to FIG. 7, it can be seen that when fully assembled, the second end portion 26 (having Velcro TM piece 28 formed thereon) is securely attached to mounting portion 38 (containing Velcro TM piece 36).

During use of the necktie 10, the replaceable tie assembly 16 is placed in the knot by opening the knot and threading the tie 16 through the tie ring 30. The tie is then adjusted in the ring 30 to the desired length by pulling it up or down through the ring. After the desired length has been set, the opened knot is closed and re-formed by securing the Velcro TM (28,36). Once the knot is closed, the ring 30 and knot will hold the tie in place.

This feature allows the user to interchange knot assemblies with tie assemblies to achieve numerous color, material and pattern combinations and obtain unlimited fashion color coordination with the user's shirts, suits, shoes and other clothes; and, dresses and suits for women. Once the desired tie and knot combination is selected and the knot is closed and properly adjusted, the tie is ready to be placed around the user's neck using the various collar assemblies described hereinbelow.

Referring again to FIG. 1, the necktie 10 preferably incorporates a collar assembly 12, illustrated in this figure. Collar assembly 12 comprises a collar-to-knot strip 40 which is passed through the collar loop 18. A collar fastener (or collar ring) 42 is attached to one end of the collar-to-knot strip 40. One end of an elastic strip 44 is fastened to a second end of the collar-to-knot strip 40. Attached to the second end of the elastic strip 44 is an elongated strip of Velcro TM 46.

A collar strip 48 contains a complimentary mating piece of Velcro TM 50. This mating strip 50 is most clearly seen in FIG. 8 which shows collar strip 48 detached from elongated strip 46. Numeral designations 52 are provided for indicating the collar length. A mating fastener for the collar ring 42, for example a hook 54, is attached to a second end of the collar strip 48.

In addition to providing much greater diversity in the combinations of ties and knots available for use and ease in maintaining the knot in a manner in which it cannot be disformed, the present invention has safety advantages that are not inherent in conventional ties. For example, the Velcro TM fastening 50 on the collar assembly 12 allows the tie to be securely tightened on the user's neck. However, if a strong enough force is transmitted from a pull on the tie, either by accident or intent, the collar assembly 12 can safely break away.

Furthermore, since the tie ring 30 is most likely threaded to the knot assembly 14, if the tie assembly 16 is pulled hard enough, the tie and ring will break away from the threads that secure it in position in the knot. These features provide a very valuable safety mechanism for the user and may prevent the serious or even fatal injuries that may occur with conventional ties.

Figure 9:
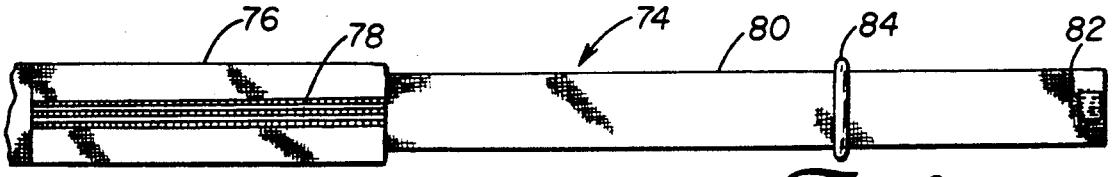
FIG. 9 illustrates a second embodiment of the collar assembly.

Referring now to FIG. 9, another embodiment of the collar assembly is illustrated, designated generally as 74. Collar assembly 74 includes a first strip 76 of tie material having a strip of Velcro TM 78 attached thereto. A second strip of tie material is securely attached to the end of strip 76. Tie material strip 80 has a complimentary piece of Velcro TM 82 attached at an end thereof. The strip 80 is threaded through a fastener or hook 84. Fastener 84 may be identical to the hook 54 illustrated in FIG. 1 for thus attaching to a collar ring located at the other end of strip 76.

Figure 10:
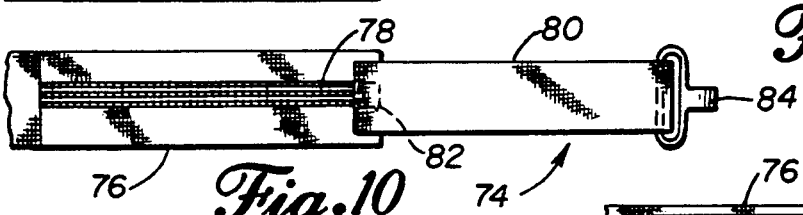
FIG. 10 illustrates the embodiment of FIG. 9 folded over to form the longest collar length possible.
Figure 11:
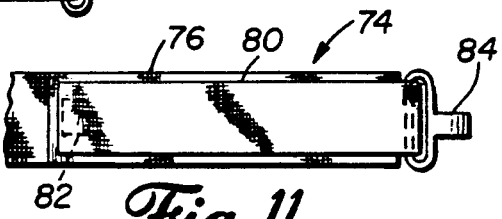
FIG. 11 is another view of the embodiment of FIG. 9 being folded to form the shortest collar length possible.

FIG. 10 illustrates the same collar assembly embodiment as FIG. 9, however the strip 80 has been folded over so that Velcro TM strip 82 meets with its complimentary half 78 at the end of strip 76, thus providing the longest length possible for the present collar assembly 74. FIG. 11 shows the Velcro TM strip 82 relocated to the other end of the Velcro TM strip 78 thereby providing the shortest length of collar possible with this embodiment.

Referring back now to FIG. 7, a tie anchor, designated generally as 56, is illustrated. Tie anchor 56 retains a necktie adjacent the wearer's shirt front. Although this tie anchor 56 is shown being incorporated with the collar assembly 12, knot assembly 14 and tie assembly 16, the tie anchor 56 may be utilized on conventional neckties and other neckties of the type having a front section 58, generally exposed to view, and a back section 60, usually concealed from view.

An elongated back section strip of Velcro TM 62 is attached to a rear surface of the back section 60. A tie anchor attachment loop 64 formed of a complimentary mating piece of Velcro TM is used to attach a closed loop 66 of elastic material which is threaded through the attachment loop 64. A clasp or clamp 68 separates the closed loop 66 into a first subloop 70 and a second subloop 72. The second subloop 72 is thus sized to efficiently engage the buttons of the wearer's shirt. The tie anchor 56 therefore adequately restrains the necktie 10 yet allows such substantial freedom of relative vertical movement between the back section 60 and shirt front as will adequately accommodate the wearer's body movements without undo tensioning of the necktie. A side view of the tie anchor 56 is illustrated in FIG. 12.

Figure 13:
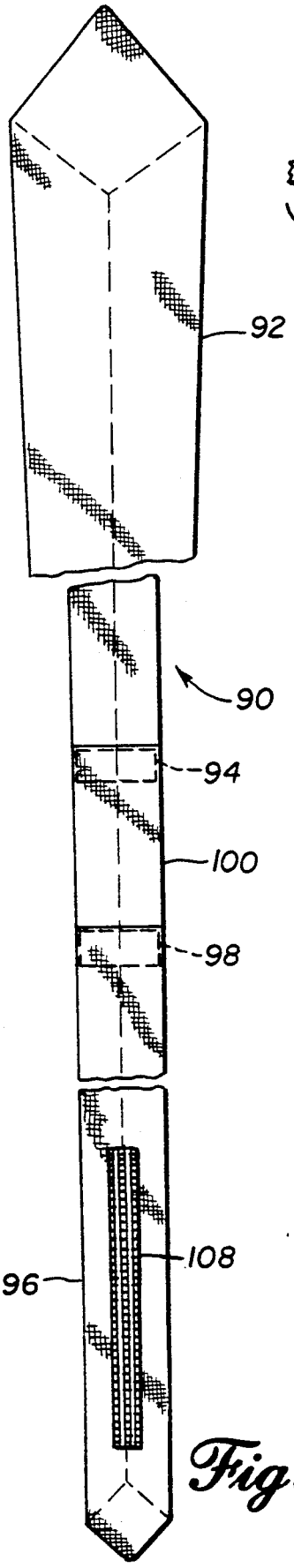
FIG. 13 illustrates the variable length necktie embodiment of the present invention.
Figure 14:
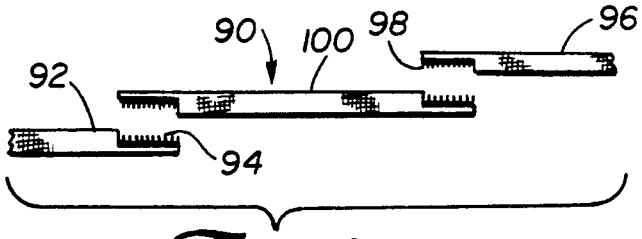
FIG. 14 is an exploded side view of the links utilized in the variable length necktie of FIG. 13.

Referring now to FIG. 13 a variable length necktie is illustrated, designated generally as 90. Necktie 90 may be used as a conventional necktie or as a replaceable tie assembly 16, as in the FIG. 1 embodiment. Necktie 90 includes a relatively wide, elongated, tapered portion 92 defining a front section of the necktie that is generally exposed to view. The wide portion has a strip of Velcro TM 94 attached at the end thereof. A narrow portion 96 defines the back section of the necktie that is usually concealed from view. Similarly, the narrow portion 96 has a strip of Velcro TM 98 located at its end. A tie link 100 is disposed between the wide portion 92 and the narrow portion 96. Tie link 100 has Velcro TM on its ends for mating with the Velcro TM strips 94, 98 of the wide portion 92 and narrow portion 96. Thus, an extension of the necktie is provided. FIG. 14 illustrates a side view of a portion of neck tie 90.

Figure 15:
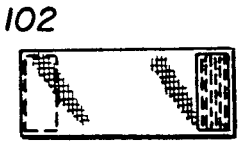
FIG. 15 illustrates a short link utilized in the variable length necktie of FIG. 13.
Figure 16:
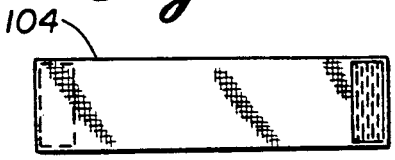
FIG. 16 illustrates a medium length link used in the variable length necktie of FIG. 13.
Figure 17:
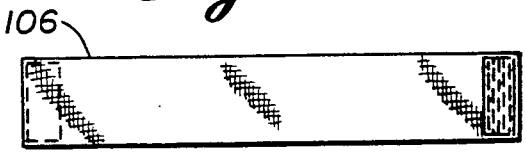
FIG. 17 illustrates a long link utilized in the subject necktie.

More than one link may be utilized to provide a multitude of variations in tie lengths. For example, it is contemplated that a short link, a medium length link, and a long link may be incorporated in the same tie. These variously sized links are designated 102, 104, and 106 in FIGS. 15, 16, and 17, respectively. For example, if the three lengths used are 2, 4 and 8 inches long, the variations in added lengths to the tie can be 0, 2, 4, 6, 8, 10, 12 or 14 inches. This results in a 48-inch tie being expanded in two-inch lengths to an overall length of 62 inches. Although the preferred method for connecting these lengths to each other and the tie is by use of Velcro TM it is understood that the ends may be connected by some other type of means such as snaps, hooks, et cetera.

Figure 18:
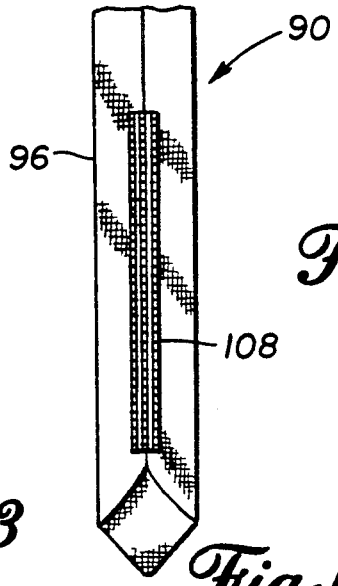
FIG. 18 is a rear view of the bottom narrow portion of the necktie of FIG. 13.
Figure 19:
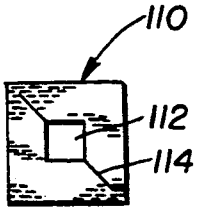
FIG. 19 is a front view of the tie retainer for holding the tie adjacent to the user's shirt.
Figure 20:
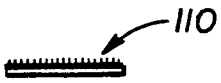
FIG. 20 is a side view of the tie retainer of FIG. 19.

FIGS. 18, 19 and 20 illustrate a preferred type of tie retainer which may be utilized with the variable length necktie 90. As shown in FIG. 18, the back face of the narrow portion 96 of the necktie 90 contains a piece of Velcro TM material 108. A tie retainer 110 is formed of a complimentary mating piece of Velcro TM having a space 112 formed therein being sized to efficiently engage the buttons of a wearer's shirt. Slits 114 are formed in the tie retainer 110 to allow the retainer to be slipped in the button. FIG. 20 illustrates a side view of tie retainer 110. Thus, the tie retainer 110 holds the narrow portion 96 of the necktie 90 adjacent the wearer's shirt during use.

Although the tie retainer 110 has been shown incorporated for use with the variable length necktie 90 it is understood that this specific use has been illustrated by way of example and not limitation. Tie retainer 110 may be used on conventional ties or, for example, with the tie illustrated in FIG. 1, instead of the tie anchor 56 illustrated in that case.

Obviously, many modifications and variations of the present invention are possible in light of the above teachings. It is therefore to be understood that, within the scope of the appended claims, the invention may be practice otherwise then as specifically described.

Figure 21:
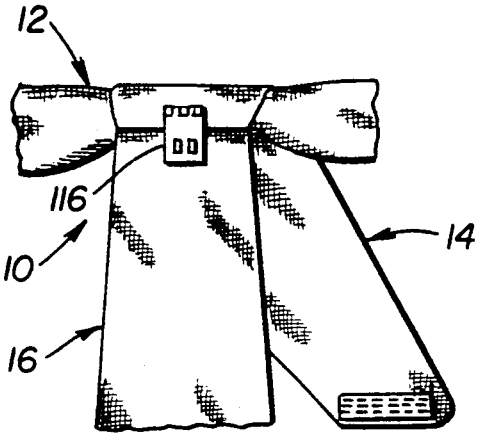
FIG. 21 illustrates an alternate embodiment of a tie assembly securing means.

For example, as illustrated in FIG. 21, instead of the tie ring 30 of the FIG. 1 embodiment, a clip 116 could be used to function as the tie assembly securing means or just the friction of the secured knot against the tie.

Figure 22:
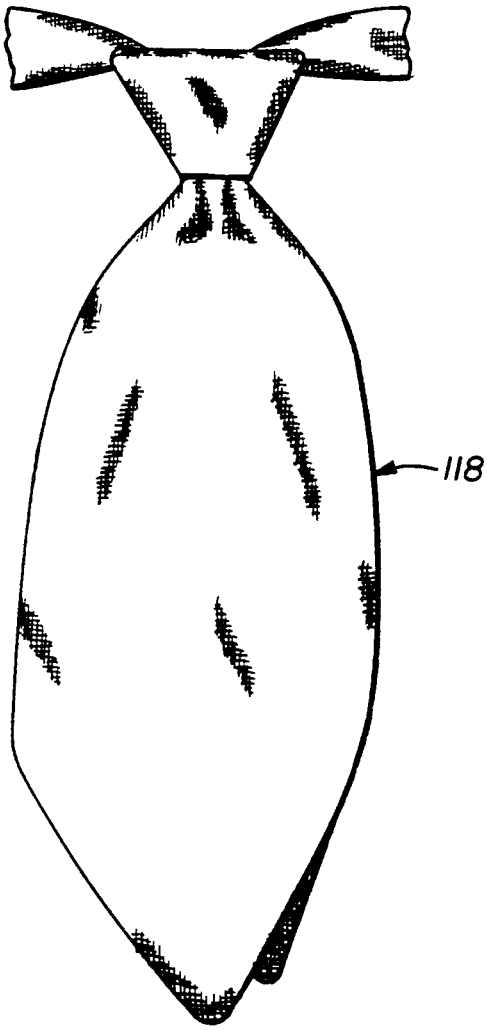
FIG. 22 illustrates the use of the principles of the present invention in application to a scarf.

Furthermore, as mentioned above, it is emphasized that the present invention has applications broader than merely with a normal man's necktie. FIG. 22 illustrates the principles of the present invention, as applied to a woman's scarf, designated generally as 118.

Additionally, it is noted that knot assembly 14 preferably has a rigid thin plastic triangular shaped support structure mounted therein (not shown) to help maintain the integrity of the shape of the resultant knot. This support structure is disposed in the portion of the knot assembly 14 that forms that front face of the knot.

What is claimed and desired to be secured by Letters Patent of the United States is:

1. An assemblable necktie, comprising:

a) a collar assembly;

b) a knot assembly comprising;

a first end portion having a collar loop formed therein for retaining said collar assembly, an intermediate portion, and, a second end portion, said first end portion, intermediate portion and said second end portion being so foldable so as to form a knot during use having the appearance of a knot in a conventional tie;

c) a replaceable tie assembly securable to said knot assembly; and, d) tie assembly securing means for securing said tie assembly to said knot assembly during use thereof, said tie assembly securing means being concealed when the tie is formed.

2. The necktie of claim 1 wherein, said intermediate portion forms a front face of a tie knot when passed substantially horizontally over said tie assembly securing means.

3. The necktie of claim 2 wherein, said first end portion includes a mounting portion which forms a rear face of said tie knot.

4. The necktie of claim 3 wherein:

a) said mounting portion includes a piece of synthetic fabric attached thereto of the type that adheres when pressed together with a complimentary mating piece of fabric; and, b) said second end portion includes said complimentary mating piece of fabric attached thereto.

5. The necktie of claim 1 wherein, said tie assembly securing mean include a tie ring secured to said first end portion of said knot assembly, the tie assembly being looped through said tie ring when said necktie is being assembled.

6. The necktie of claim 1, wherein, said collar assembly, comprises:

a) a collar-to-knot strip for being passed through said collar loop, said collar-to-knot strip having a first end and a second end;

b) a collar fastener attached to said first end of said collar-to-knot strip;

c) an elastic strip fastened, on one end, to said second end of said collar-to-knot strip;

d) an elongated strip of synthetic fabric of the type that adheres when pressed together with a complimentary mating piece of fabric, said elongated strip being attached to a second end of said elastic strip;

e) a collar strip having said complimentary mating piece of fabric attached at a first end thereof; and, f) a mating fastener for said collar fastener attached to a second end of said collar strip.

7. The collar assembly of claim 6 wherein:

a) said collar fastener includes a collar ring and said mating fastener includes a hook; and, b) said elongated strip includes numerical designations indicating collar lengths.

8. The necktie of claim 1, further including a tie anchor for retaining said necktie assembly adjacent the wearer's shirt front, said necktie assembly having a front section generally exposed to view and a back section usually concealed from view, comprising:

a) an elongated back section strip of synthetic material of the type that adheres when pressed together with a complimentary mating piece of fabric, said elongated strip being attached to a rear surface of said back section;

b) a tie anchor attachment loop formed of said complimentary mating piece of fabric;

c) a closed loop of elastic material threaded through said attachment loop;

d) a clasp for separating said closed loop of elastic material into a first subloop for attachment to said attachment loop and a second subloop, said second subloop being sized to efficiently engage the buttons of the wearer's shirt, said tie anchor adequately restraining said necktie yet allowing such substantial freedom of relative vertical movement between the necktie and the shirt front as will adequately accommodate the wearer's body movements without undo tensioning of said necktie.

9. The necktie of claim 1 wherein, said replaceable tie assembly comprises:

a) a relatively wide, elongated, tapered portion defining a front section of the necktie assembly that is generally exposed to view, said wide portion having a strip of synthetic fabric of the type that adheres when pressed together with a complimentary mating piece of fabric, said elongated strip being attached to the end of a narrower part of said wide portion;

b) a narrow portion defining a back section of the neck tie assembly that is usually concealed from view, said narrow portion having a strip of synthetic fabric of the type that adheres when pressed together with the complimentary mating piece of fabric, said strip being attached to an end of said narrow portion;

c) at least one tie link comprising an elongated strip of tie material having a first end and a second end, said first end having a strip of synthetic fabric of the type that adheres when pressed together with a complimentary mating piece of fabric, said strip being attached to a first face of said tie link, said second end having a similar strip of synthetic strip of material attached to a second face opposite said first face, said first and second ends of said tie link thereby being capable of mating with either another tie link, the end of said narrow portion, or the end of the narrower part of said wide portion.

10. A method of assembling a neck tie, comprising the steps of:

a) providing a collar assembly;

b) providing a knot assembly, comprising;

a first end portion having a collar loop formed thereon for retaining said collar assembly, an intermediate portion, and, a second end portion, said first end portion, said intermediate portion, and said second end portion being so foldable so as to form a knot during use having the appearance of a knot in a conventional tie;

c) providing a replaceable tie assembly securable to said knot assembly;

d) providing tie assembly securing means for securing said tie assembly to said knot assembly during use thereof, said tie assembly securing means being concealed when the tie is formed;

e) slipping an end of said collar assembly through said collar loop;

f) securing said tie assembly to said knot assembly;

g) passing said intermediate portion horizontally over said tie assembly securing means to form a front face of a tie knot;

h) passing said second end portion of said knot assembly horizontally around said tie assembly securing means; and, i) securing the end of said second end portion to a back of said knot assembly.

11. A tie anchor for retaining a necktie adjacent the wearer's shirt front, said necktie of the type having a front section generally exposed to view and a back section usually concealed from view, comprising:

a) an elongated back section strip of synthetic material of the type that adheres when pressed together with a complimentary mating piece of fabric, said elongated strip being attached to a rear surface of said back section;

b) a tie anchor attachment loop formed of said complimentary mating piece of fabric;

c) a closed loop of elastic material threaded through said attachment loop; and, d) a clasp for separating said closed loop elastic material into a first subloop for attachment to said attachment loop and a second subloop, said second subloop being sized to efficiently engage the buttons of the wearer's shirt, said tie anchor adequately restraining said necktie yet allowing such substantial freedom of relative vertical movement between the necktie and the shirt front as will adequately accommodate the wearer's body movements without undo tensioning of said necktie.

12. A variable length necktie, comprising:

a) a relatively wide, tapered portion defining a front section of a necktie that is generally exposed to view, said wide portion having a strip of synthetic fabric of the type that adheres when pressed together with a complimentary mating piece of fabric, said elongated strip being attached to an end of a narrower part of said wide portion;

b) a narrow portion defining a back section of a neck tie that is usually concealed from view, said narrow portion having a strip of synthetic fabric of the type that adheres when pressed together with the complimentary mating piece of fabric, said strip being attached to an end of said narrow portion;

c) at least one tie link comprising an elongated strip of tie material having a first end and a second end, said first end having a strip of synthetic fabric of the type that adheres when pressed together with complimentary mating piece of fabric, said strip being attached to a first face of said tie link, said second end having a similar strip of synthetic strip of material attached to a second face opposite said first face, said first and second ends of said tie link thereby being adapted to mate with either another tie link, the end of said narrow portion, or the end of the narrower part of said wide portion.

13. The variable length necktie of claim 12, further including:

a) an elongated strip of synthetic fabric of the type that adheres when pressed together with a complimentary mating piece of fabric, said elongated strip being attached to a back face of said narrow portion of said necktie; and, b) a tie retainer formed of said complimentary mating piece having a space formed therein being sized to efficiently engage the button of the wearer's shirt.

* * * * *